US009194192B2

(12) United States Patent
Mosing et al.

(10) Patent No.: US 9,194,192 B2
(45) Date of Patent: Nov. 24, 2015

(54) APPARATUS AND METHODS FOR LIMITING MOVEMENT OF GRIPPING MEMBERS

(75) Inventors: Donald E. Mosing, Lafayette, LA (US); Jeremy Richard Angelle, Lafayette, LA (US); John Erick Stelly, Breaux Bridge, LA (US)

(73) Assignee: Frank's International, LLC, Houston, TX (US)

( * ) Notice: Subject to any disclaimer, the term of this patent is extended or adjusted under 35 U.S.C. 154(b) by 593 days.

(21) Appl. No.: 13/578,463

(22) PCT Filed: Sep. 22, 2011

(86) PCT No.: PCT/US2011/052768

§ 371 (c)(1),
(2), (4) Date: Aug. 10, 2012

(87) PCT Pub. No.: WO2012/040469

PCT Pub. Date: Mar. 29, 2012

(65) Prior Publication Data

US 2012/0312553 A1 Dec. 13, 2012

Related U.S. Application Data

(60) Provisional application No. 61/403,829, filed on Sep. 22, 2010.

(51) Int. Cl.
*E21B 19/07* (2006.01)
*E21B 19/10* (2006.01)

(52) U.S. Cl.
CPC ..... *E21B 19/07* (2013.01); *E21B 19/10* (2013.01)

(58) Field of Classification Search
None
See application file for complete search history.

(56) References Cited

U.S. PATENT DOCUMENTS

| | | | | |
|---|---|---|---|---|
| 2,607,098 | A * | 8/1952 | Wilson | 188/67 |
| 2005/0051324 | A1 | 3/2005 | Mosing et al. | |
| 2009/0056933 | A1 | 3/2009 | Campisi et al. | |
| 2009/0272542 | A1 | 11/2009 | Begnaud et al. | |
| 2010/0200215 | A1 | 8/2010 | Juhasz et al. | |

OTHER PUBLICATIONS

International Preliminary Report on Patentability issued in PCT/US2011/052768, mailing date Apr. 4, 2013 (6 pages).
International Search Report from PCT/US2011/052768 dated Apr. 23, 2012 (3 pages).

* cited by examiner

*Primary Examiner* — Jennifer H Gay
*Assistant Examiner* — Caroline Butcher
(74) *Attorney, Agent, or Firm* — Osha Liang LLP

(57) ABSTRACT

Apparatus and method for limiting movement of gripping members of an elevator are provided. The apparatus includes a locking arm coupled to one or more of the gripping members and configured to move in a first direction when the gripping members move toward engagement with a tubular and to move in a second direction when the gripping members move away from engagement with the tubular. The apparatus also includes a first engagement member configured to move between a disengaged position, in which the first engagement member and the locking arm are relatively moveable, and an engaged position, in which the first engagement member allows the locking arm to move in the first direction but restrains the locking bar from moving in the second direction by more than a selected distance.

18 Claims, 7 Drawing Sheets

APPARATUS AND METHODS FOR LIMITING MOVEMENT OF GRIPPING MEMBERS

CROSS-REFERENCE TO RELATED APPLICATIONS

This application is a national stage application of PCT/US2011/052768, filed on Sep. 22, 2011, entitled "Apparatus and Methods for Limiting Movement of Gripping Members," which claims priority to U.S. Provisional Patent Application No. 61/403,829, filed on Sep. 22, 2010. Each of these applications is incorporated herein by reference in their entireties.

BACKGROUND

Elevators are generally employed in casing, drilling, and other wellbore operations to hoist and lower tubulars (e.g., casing or drill pipe) into the wellbore. The elevators may be coupled to a travelling block of the rig, and maneuvered to engage and hoist a tubular. The tubular is then brought into position and attached ("made up") to a lower tubular, which is already positioned in the wellbore, and then lowered. One common type of elevator employs slips that support the tubular by biting into or otherwise engaging the outer diameter of the tubular. Slip-type elevators generally include a "bowl" and several slips, which can be circumferentially spaced apart. When the elevator is disposed around a tubular, the slips can be lowered into the bowl, thereby adjusting the slips to move radially inward into engagement with the tubular. Downward force on the slips from the weight of tubular/tube string provides the gripping force for the slips.

This arrangement has proven effective in a variety of different applications. However, during running operations, it is not uncommon for the tube string to catch on a wellbore impediment. The rig operators may be unaware of the instant such catching occurs, and thus the elevator may continue to be lowered as the tube string is temporarily supported on such an impediment. Accordingly, the elevator may be relieved of the weight of the tube string, which, as noted, the elevator uses to provide the gripping force. This situation can lead to a drop of the tube string, which can be costly, or even catastrophic, to wellbore operations Attempts to address this potential have met with challenges. For example, existing devices useable to lock elevator slips into place generally require one or more manual adjustments and/or calibrations prior to use, to accommodate the diameter of the elevator and/or the tubular to be gripped. This introduces an additional potential for human error, takes valuable time in the running process, and generally does not permit lowering of the slips to engage a tubular while the locking devices themselves are operatively engaged.

What is needed, therefore, is an improved apparatus and method for limiting slip movement in an elevator.

SUMMARY

Embodiments of the disclosure may provide an exemplary apparatus for limiting movement of gripping members relative to an elevator. The apparatus may include a locking arm coupled to one or more of the gripping members and configured to move in a first direction when the gripping members move toward engagement with a tubular and to move in a second direction when the gripping members move away from engagement with the tubular. The apparatus may also include a first engagement member configured to move between a disengaged position, in which the first engagement member and the locking arm are relatively moveable, and an engaged position, in which the first engagement member allows the locking arm to move in the first direction but restrains the locking bar from moving in the second direction by more than a selected distance.

Embodiments of the disclosure may further provide an exemplary apparatus for gripping a tubular. The apparatus may include an annular body defining a longitudinal bore configured to receive the tubular therethrough, and slips disposed at least partially in the longitudinal bore, the slips being moveable radially and longitudinally into and out of engagement with the tubular. The apparatus may also include a locking arm coupled to one or more of the slips and configured to move in a first direction when the slips move toward engagement with the tubular and to move in a second direction when the slips move away from engagement with the tubular. The apparatus may further include a first engagement member configured to move between a disengaged position, in which the first engagement member and the locking arm are relatively moveable, and an engaged position, in which the first engagement member allows the locking arm to move in the first direction but restrains the locking bar from moving in the second direction by more than a selected distance.

Embodiments of the disclosure may also provide an exemplary method for limiting movement of slips of an elevator relative to the elevator. The method may include moving the slips into engagement with a tubular, wherein moving the slips requires a locking arm to move. The method may also include engaging the locking arm with a first engagement member. Engagement between the locking arm and the first engagement member permits movement of the locking arm in a first direction and provides an end range for movement of the locking arm in a second direction, to limit movement of at least one of the slips relative to the elevator.

DETAILED DESCRIPTION

Figure 1:
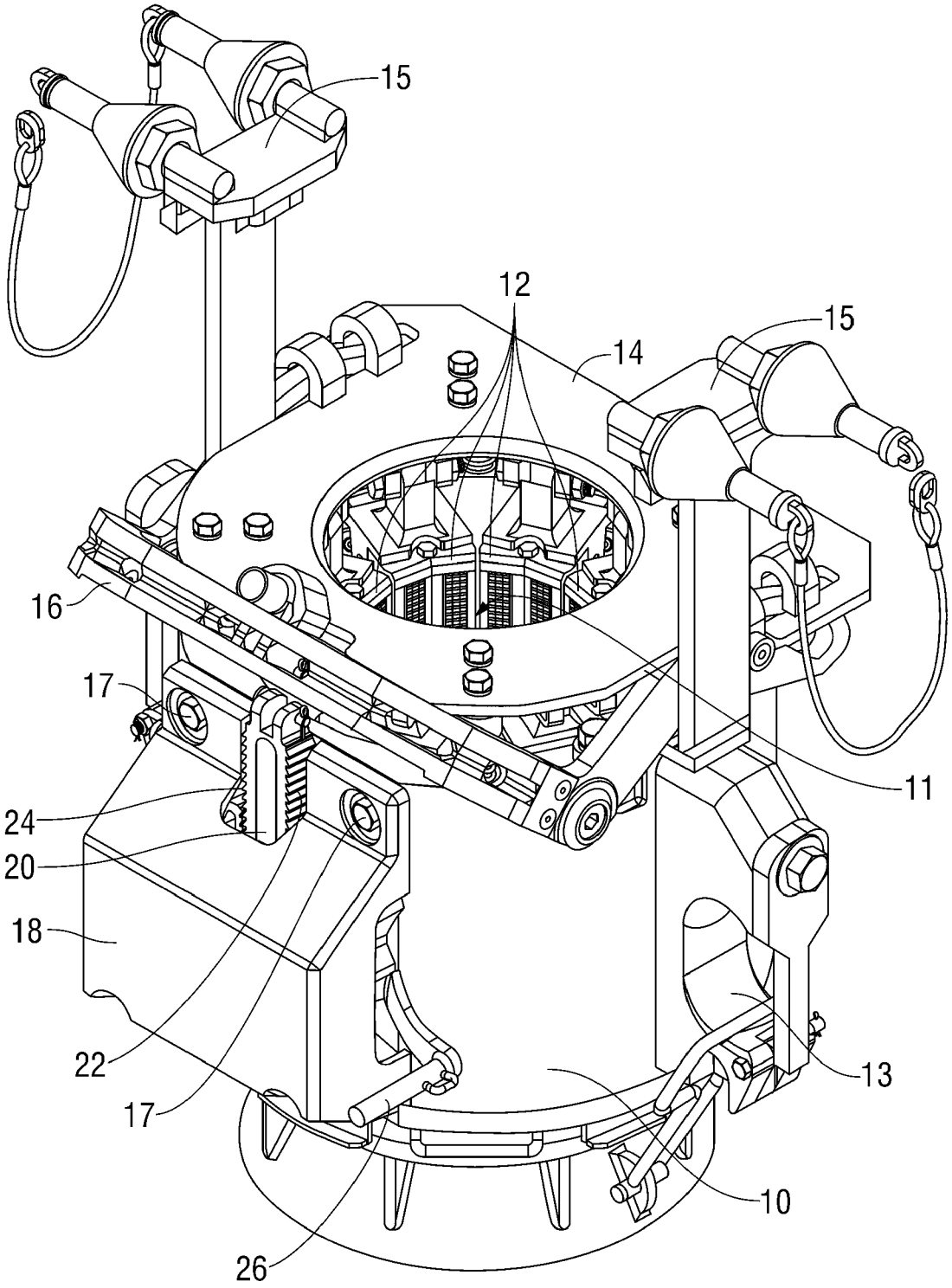
FIG. 1 illustrates a perspective view of an exemplary elevator, according to one or more embodiments described.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

FIG. 1 illustrates a perspective view of an elevator 1, having a generally annular elevator body 10 defining a longitudinal bore 11. The elevator 1 has one or more gripping members or "slips" 12 disposed at least partially therein. Although not individually labeled, the slips 12 may include a body and/or retainer movable into and from a bowl-shaped region of the elevator body 10 to engage and disengage a tubular, respectively. The body and/or retainer of each slip 12 may include teeth, marking gripping surfaces, non-marking gripping surfaces, shoulders, combinations thereof, or may receive an insert including such teeth, surfaces, and/or shoulders for engagement with the tubular (not shown). In other exemplary embodiments, however, the elevator 10 may not include slips and thus may be configured to otherwise engage, hoist, and lower a tubular or may be another type of running tool or gripping device.

The elevator 1 may further include ears 13 and stabilizing members 15 for engaging bails (not shown) and orienting and/or moving the elevator 1. The elevator 1 may be positioned with a tubular (not shown) received through the bore 11. The slips 12 may be moveable radially and/or longitudinally in the bore 11. For example, the slips 12 may be movable between a lowered, engaged position, where they may engage a tubular (not shown), and a raised, disengaged position, where the slips 12 may allow independent movement between the elevator 1 and the tubular. The slips 12 may be moved between the engaged and disengaged positions manually or through any remote, hydraulic, pneumatic, or electrical devices and methods. Further, the elevator 1 may also include a timing ring 14 coupled to the slips 12, such that movement of the timing ring 14 moves the slips 12. The timing ring 14 may in turn be coupled with a yoke 16, which may be manually, remotely, etc. manipulated to raise and/or lower the timing ring 14, thereby raising and/or lowering the slips 12.

The elevator 1 also includes an exemplary apparatus 2 for limiting movement of the slips 12 relative to the elevator 1. The apparatus 2, or at least portions thereof, may be fastened to the elevator body 10 using bolts 17, however other methods and devices of coupling, such as fastening with other types of fasteners (e.g., pins or rivets), welding, brazing, adhering, or integral forming, may also be used in lieu of in addition to the depicted bolts 17. The apparatus 2 includes a cover or housing 18, from which a locking arm 20 extends to engage the yoke 16. For example, movement of the slips 12, and thus the timing ring 14 and yoke 16, may cause movement of the locking arm 20, and vice versa. More particularly, in at least one exemplary embodiment, movement of the slips 12 downward with respect to the body 10 to engage a tubular may require upward movement of the locking arm 20 through the connection between the locking arm 20 and the yoke 16, while upward movement of the slips 12 relative the body 10 (i.e., away from the elevator bowl) may require downward movement of the locking arm 20.

The locking arm 20 may include two or more sets of teeth; for example, first and second sets of teeth 22, 24, disposed on opposite longitudinal sides of the locking arm 20, as shown. An actuation member, e.g., a handle 26, may also extend from the housing 18. The handle 26 may be coupled with the slips 12, the timing ring 14, and/or the yoke 16, such that actuation of the depicted apparatus 2 using the handle 26 may cause or prevent movement of the slips 12, as will be described in greater detail below. Other remote, hydraulic, pneumatic, and/or electrical devices or methods for actuation, in addition to or in lieu of the manual handle 26, may be used to engage and disengage the apparatus.

Figure 2:
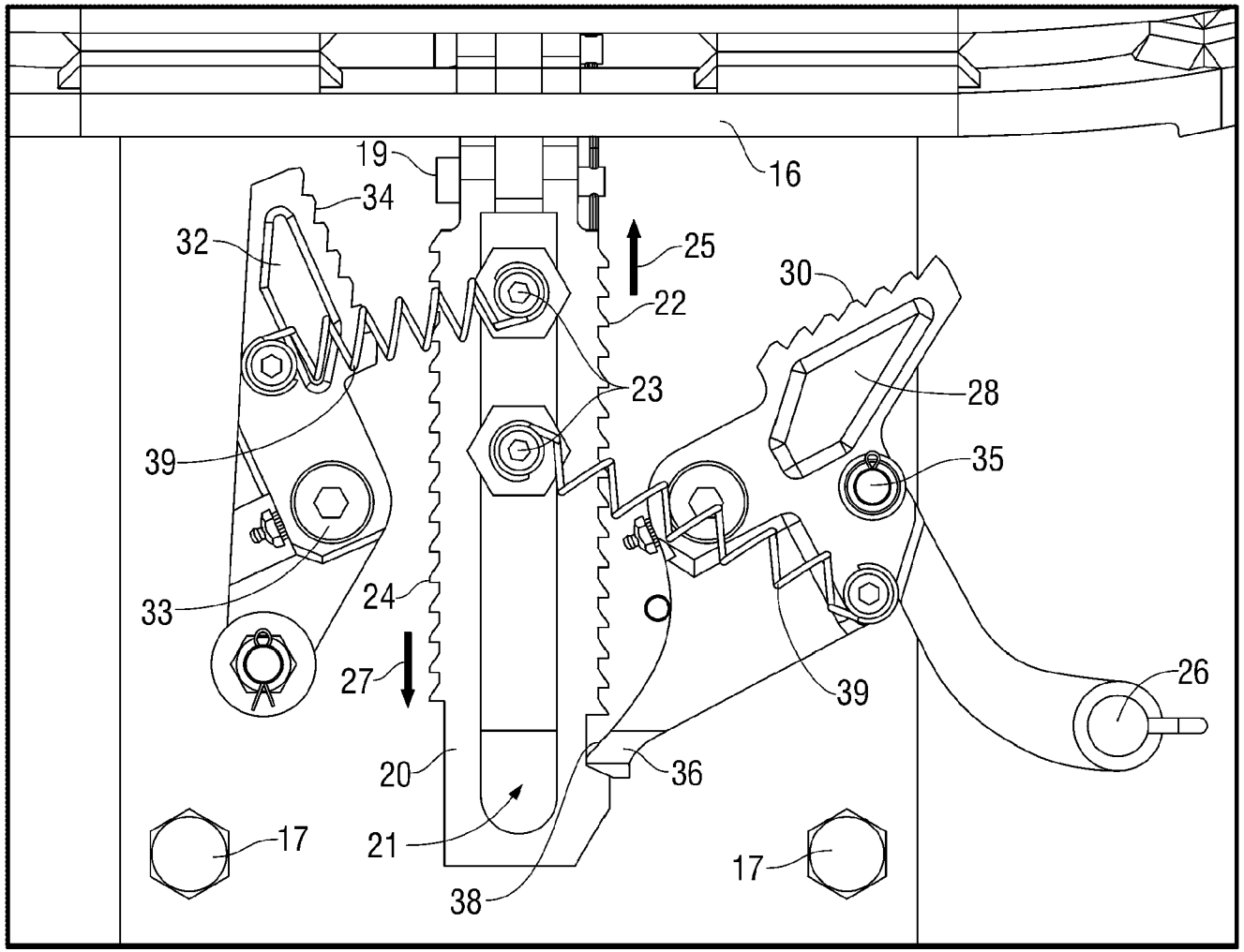
FIG. 2 illustrates a front view of an exemplary apparatus for limiting movement of slips of an elevator, according to one or more embodiments described.

With continuing reference to FIG. 1, FIG. 2 illustrates a front view of the exemplary apparatus 2, according to an embodiment, with the housing 18 removed for illustrative purposes. The locking arm 20 is shown engaged with the yoke 16, as described above, such that movement of the slips 12 downward with respect to the elevator body 10 to engage a tubular causes the yoke 16 and thus the locking arm 20 to move in a first or "upward" direction 25. Further, movement of the slips 12 upward with respect to the elevator body 10 causes the yoke 16 and thus the locking arm 20 to move in a second or "downward" direction 27. To reiterate, it will be appreciated that directional language such as "upward" or "downward" as used herein is not intended to be limiting, but is instead conveniently used to indicate a relative positioning or direction among elements, as shown in the drawings.

A fastener such as a pin 19 may be engaged through complementary orifices within the yoke 16 and/or locking arm 20. Although not shown, in another exemplar embodiment, a protrusion of one of the yoke 16 and the locking arm 20 may engaged the other through a complementary orifice (not shown). Further, the locking arm 20 may have a central slot or orifice 21 through which two or more fasteners, e.g., bolts 23 may secure the locking arm 20 to the elevator body 10. Movement of the locking arm 20 in the upward and downward directions 25, 27 relative to the elevator body 10 and the bolts 23 is thereby permitted and guided by the engagement of the bolts 23 through the slot 21.

The apparatus 2 may also include one or more engagement members or "arms" (two shown: 28, 30). The engagement arms 28, 30 may also be referred to as a contacting, gripping, and/or movement-limiting member. In an exemplary embodiment, the first engagement arm 28 may include a first set of complementary teeth 30, and the second engagement arm 32 may include a second set of complementary teeth 34. The engagement arms 28, 32 may be pivotally coupled to the elevator body 10, such that the engagement arms 28, 32 can selectively engage or disengage from the locking arm 20. Accordingly, the engagement arms 28, 32 may be coupled to the elevator body 10 using a pivot pin 33 or the like. In other embodiments, the engagement arms 28, 32 can be linearly moveable, rather than, or in addition to, being pivotally movable.

Further, the handle 26 may be coupled to the first engagement arm 28 to enable movement thereof between engaged and disengaged positions. A connecting member (shown in and described below with reference to FIGS. 3 and 4) may be used to connect the first and second engagement arms 28, 32 such that use of the handle 26 to move the first engagement arm 28 between effects a corresponding movement of the second engagement arm 32. In other embodiments, two or more handles 26, e.g., one for each engagement arm 28, 32, may be employed to independently move each of the engagement arms 28, 32. Further, in embodiments including more than two engagement arms, a single or multiple handles 26 may be employed, with each handle coupled to one, two, or more engagement arms 28, 32. Moreover, it although the engagement arms 28, 32 are shown to be moveable (e.g., pivotal) with respect to the locking arm 20, in other embodiments, the locking arm 20, the elevator body 10, or other parts of the apparatus 2 and/or elevator 1 may be movable to cause contact between the engagement arms 28, 32 and the locking arm 20.

The first engagement arm 28 may have an extension 36, which engages a corresponding notch 38 in the locking arm 20 to maintain the engagement arms 28, 32 in a disengaged position. In an exemplary embodiment, engagement between the extension 36 and the notch 38 can maintain the slips 12 in a disengaged position by preventing movement of the locking arm 20 in the downward direction 27. In another embodiment, the slips 12, timing ring 14, and/or yoke 16 may be otherwise coupled to the handle 26. Moreover, the engagement arms 28, 32 may be biased toward the locking arm 20, such that when the extension 36 is disengaged from the notch 38, the engagement arms 28, 32 is urged toward, e.g., into engagement with, the locking arm 20. Such biasing may be effected by resilient, coiled tension springs 39, as shown. The springs 39 can be engaged with the bolts 23, the locking arm 20, or another portion of the apparatus to bias the engagement arms 28, 32 toward the locking arm 20. In other embodiments, biasing force may be supplied by any biasing device, such as one or more leaf springs, torsion springs, compression springs, elastic bands, hydraulic actuators, electromechanical actuators, mechanical linkages, combinations thereof and/or combinations with the illustrated coiled tension springs 39, or the like.

It will be appreciated that while FIG. 2 depicts an arrangement of components in which the locking arm 20 moves in upward and downward directions 25, 27 concurrent with movement of the slips 12 in a generally opposing direction, this is but one example among many contemplated herein. For example, other embodiments may employ gears, biasing members, connectors, etc., such that the locking arm 20 can be configured to move in the same direction as the slips 12 or in any other desired directions when the slips 12 are moved toward or away from engagement with a tubular.

Moreover, in an exemplary embodiment, rather than being linearly moveable, the locking arm 20 may be a rotatable gear, configured to rotate according to slip 12 movement. In such an embodiment, the locking arm 20 may be configured to rotate in a first direction when the slips 12 move toward engagement with the tubular and configured to rotate in the opposite direction when the slips 12 move away from engagement with the tubular. As such, the engagement members 28, 30 may be configured to allow the rotation in the first direction, but generally prevent rotation in the opposite direction, when engaged.

Figure 3:
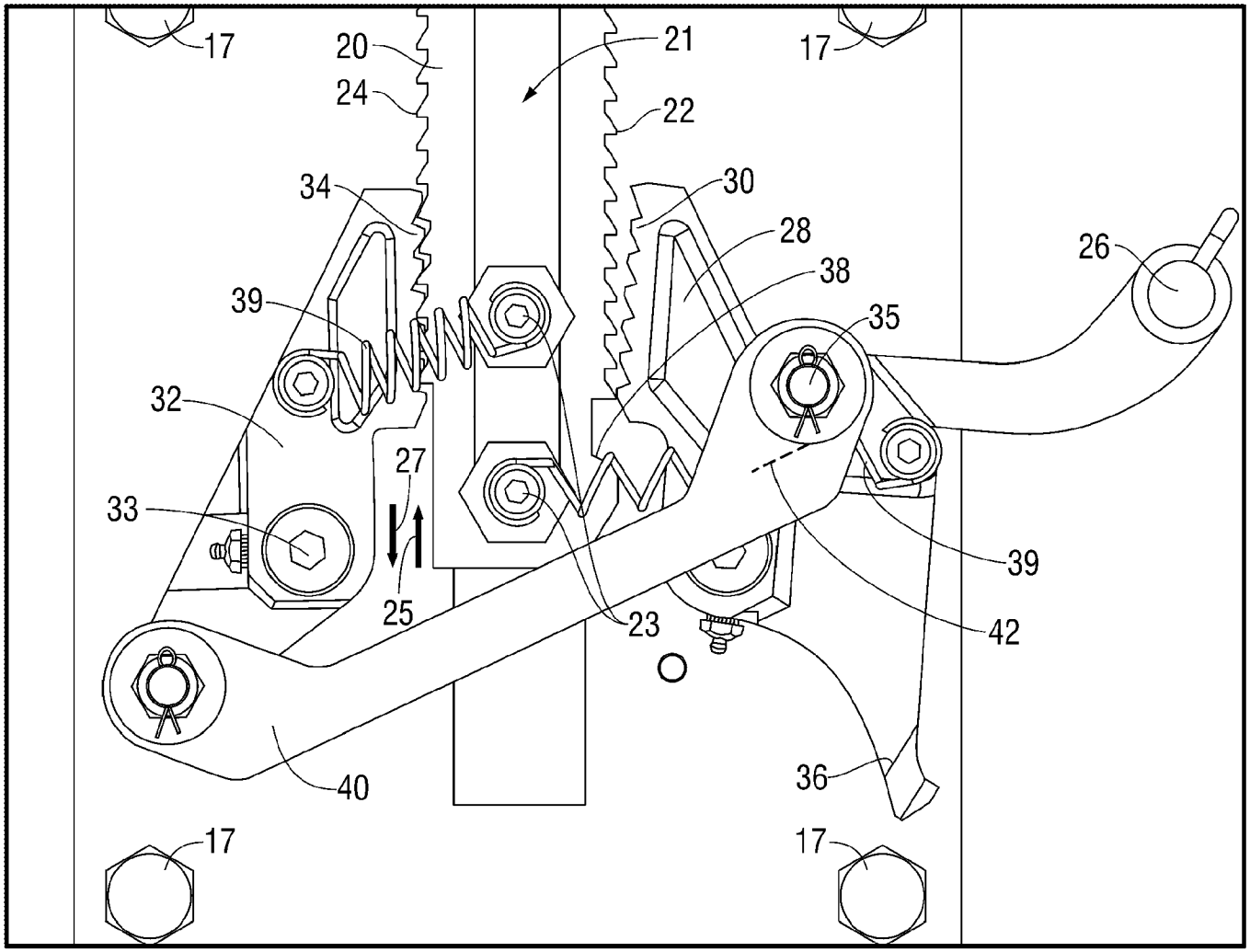
FIG. 3 illustrates a front view of the apparatus of FIG. 2 in an engaged position, according to one or more embodiments described.

FIG. 3 illustrates a partial front view of the exemplary apparatus 2 in an engaged position, according to an embodiment. As shown, the engagement arms 28, 32 have been pivoted about the pin connections 33 from the disengaged position shown in FIG. 2, such as through movement of the handle 26 and/or use of biasing members 39, to disengage the extension 36 from the notch 38. While the depicted apparatus 2 is in the engaged position, the complementary teeth 30 of the first engagement arm 28 are received between at least some of the first set of teeth 22 of the locking arm 20, and the complementary teeth 34 of the second engagement arm 32 are received between at least some of the second set of teeth 24 of the locking arm 20. A connecting member 40, as referenced above, is shown engaged to both the first and second engagement arms 28, 32 via bolt or pin connections 35, for example, such that movement of the first engagement arm 28 between engaged and disengaged positions precipitates movement of the second engagement arm 32 between engaged and disengaged positions.

The teeth 22, 24 of the locking arm 20 may have a generally wedge-shaped and/or triangular profile, having a steeply angled upper surface, and a generally straight and/or slightly angled lower surface. The complementary teeth 30, 34 of the engagement arms 28, 30 are shown having a generally wedge-shaped and/or triangular profile with a steeply angled lower surface and a generally straight and/or slightly angled upper surface. Thus, while the teeth 30, 34 of the engagement arms 28, 32 are in contact with the locking arm 20, movement of the locking arm 20 in the upward direction 25, corresponding to downward movement of the slips 12 to engage a tubular, is permitted, as the teeth 22, 24 of the locking arm 20 slide over the complementary teeth 30, 34 of the engagement arms 28, 32.

Further, the connecting member 40 may have a groove, slot, or similar elongate orifice 42 at the point of attachment with the first engagement arm 28, to permit a range of independent movement of the engagement arms 28, 32 along the locking arm 20 during this movement. For example, the groove 42 can be sized to permit lateral movement of the first engagement arm 28 caused by contact between the complementary teeth 30 thereof and the teeth 22 of the locking arm 20, without transmitting this movement to the second engagement arm 32. The groove 42 can also permit movement of the second engagement arm 32 independently of the first engagement arm 28 in a similar manner.

While the teeth 30, 34 of the engagement arms 28, 32 are in contact with the locking arm 20, movement of the locking arm 20 in the downward direction 27, corresponding to upward, disengaging movement of the slips 12 relative to the elevator body 10 (FIG. 1) may be limited through abutment between the generally straight and/or slightly angled surfaces of one or more sets of teeth 20, 24, 30, 34. As shown in FIG. 3, while the complementary teeth 30, 34 of the engagement arms 28, 32 contact the teeth 22, 24 of the locking arm 20, neither set of complementary teeth 30, 34 is interlocked with the corresponding teeth 22, 24 of the locking arm (20), e.g., the generally straight and/or slightly angled surfaces of the teeth are not shown in abutment. Thus, a small downward movement of the locking arm 20 may be allowed before the second set of teeth 24 are interlocked with the complementary teeth 34 of the second engagement arm 32.

Figure 4:
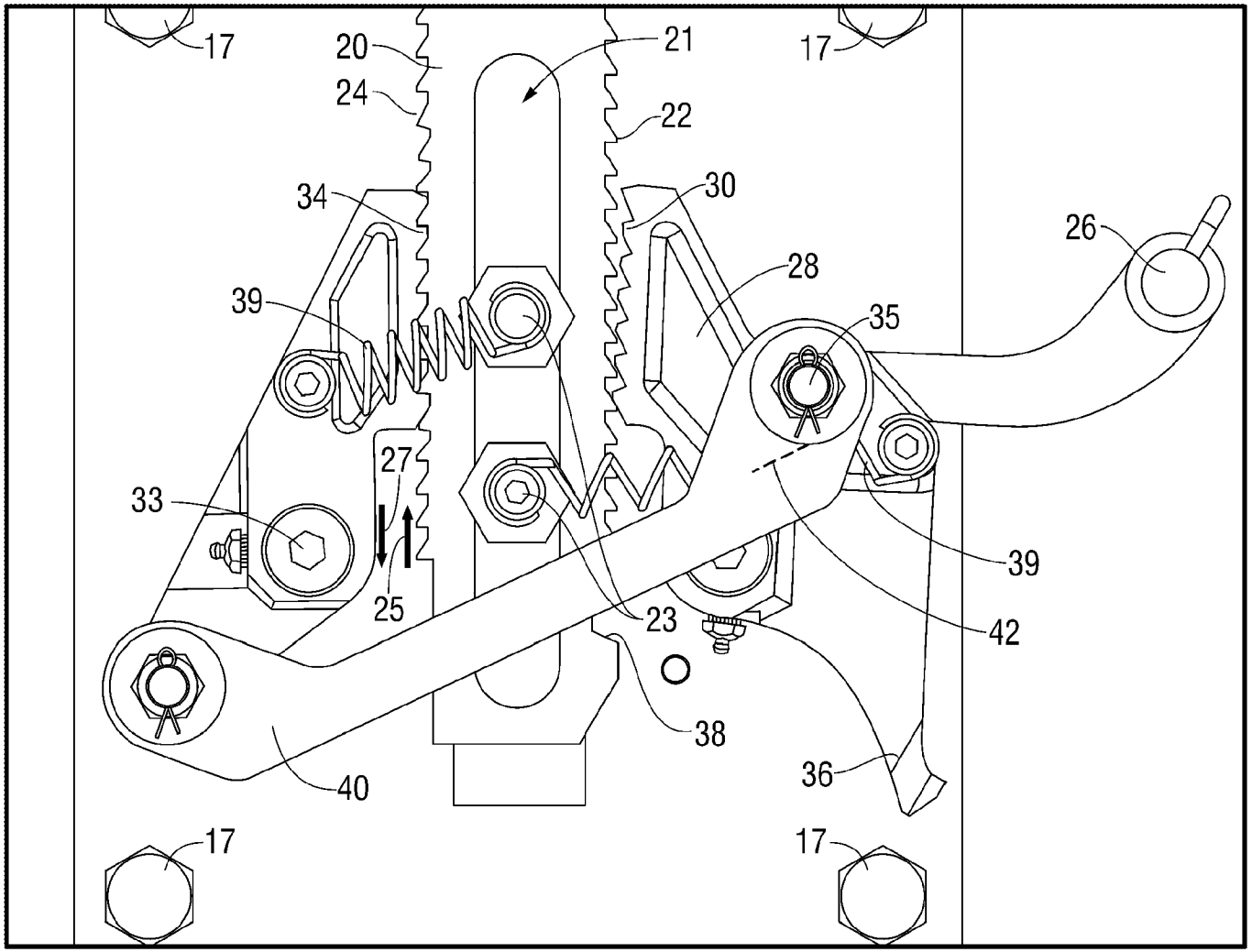
FIG. 4 illustrates a front view of the apparatus of FIGS. 2 and 3 in an interlocked position, according to one or more embodiments described.

FIG. 4 illustrates a partial front view of the exemplary apparatus 2 of FIGS. 2 and 3, according to an embodiment, in an interlocking position after the allowed small downward movement of the locking arm 20, corresponding to a small upward movement of the slips 12 (FIG. 1). The teeth 34 of the second engagement arm 32 are interlocked with the second set of teeth 24 of the locking arm 20, such that the generally straight and/or slightly angled lower surfaces of the second set of teeth 24 abut the generally straight and/or slightly angled upper surfaces of the complementary teeth 34, thereby preventing further movement of the locking arm 20 in the downward direction 27. While the specific point along the locking arm 20 contacted by the engagement arms 28, 32 may vary depending on the dimensions of the elevator 1, the slips 12, and/or the tubular (not shown), it should be noted that the maximum distance the locking arm 20 travels before achieving an interlocked position with one of the engagement arms 28, 32, as shown in FIG. 4, may depend upon the spacing between the teeth 22, 24, 30, 34.

Moreover, the first set of teeth 22 may be longitudinally offset (i.e., staggered) with respect to the second set of teeth 24. For example, the second set of teeth 24 may be positioned below the corresponding teeth on the first set of teeth 22 by a distance of about one-half the pitch (i.e., the distance between corresponding points of two adjacent teeth) of the teeth 22 and/or 24. In a specific example, the teeth 22, 24 may have a pitch of about 0.5 inches, and the second set of teeth 24 may be offset from the first set of teeth 22 by about 0.25 inches. In other exemplary embodiments, the offset distance may range from a low of ⅕, about ¼, or about ⅓ of the pitch to a high of about ¾, about ⅘, or about ⅚ of the pitch. Alternatively or additionally, in another embodiment, the first and second engagement members 28, 32 may be longitudinally offset, such that the teeth 30, 34 thereof are likewise offset.

With the engagement arms 28, 32 in the engaged position, a selected maximum distance or end range may be provided for downward movement of the locking arm 20 relative to the engagement arms 28, 32 before one of the sets of teeth 22, 24 becomes interlocked with the corresponding set of complementary teeth 30, 34. For example, the selected distance may be approximately one-half the pitch of the teeth 22 and/or 24 (e.g., 0.25 inches). Thus, through use of two sets of vertically offset teeth 22, 24, the permitted movement of the locking arm 20 may be limited in a manner substantially similar to the movement that would be permitted were a single set of teeth provided with closer spacing. The larger pitch allowed, however, enables the teeth 22, 24, 30, 34 to be thicker and thus of a more robust construction. Although the depicted embodiment includes two engagement arms 28, 32 adapted for engagement with two corresponding sets of teeth 22, 24 being offset by a selected distance, the apparatus 2 may include any number of engagement arms, including a single engagement arm, with the teeth having any desired pitch and, in multiple engagement arm embodiments, with any desired offset, including no offset, between the engagement arms.

In exemplary operation, the apparatus 2 is actuated, such as through use of the handle 26, removing the extension 36 from the notch 38 and causing at least one engagement arm 28, 32 (e.g., both) to contact the locking arm 20. The slips 12 can be lowered into the elevator body 10 before actuating the apparatus, after actuating the apparatus, or simultaneously therewith. In an exemplary embodiment, engagement between the extension 36 and the notch 38 can retain the slips 12 in a raised position, e.g., through the attachment of the slips 12 to the locking arm 20 via the timing ring 14 and yoke 16. Independent of the time at which the apparatus 2 is actuated, downward movement of the slips 12 into the elevator body 10 to engage a tubular may be permitted due to the shape of the teeth 22, 24, 30, 34, which may be adapted to allow movement of the locking arm 20 in an upward direction 25 relative to the engagement arms 28, 32. Should upward movement of the slips 12 be attempted while the apparatus 2 is engaged, the slips 12 may be permitted to move a small distance away from the elevator body 10, causing the locking arm 20 to travel in the downward direction 27 until the one or more sets of teeth 22, 24 along the locking arm 20 are interlocked with complementary teeth 30, 34 of one or more engagement arms 28, 32. This interlocking engagement prevents further movement of the locking arm 20, preventing further movement of the slips 12.

In an embodiment, the permitted movement of the slips 12 may not be sufficient for the slips 12 to drop the shaft (i.e., a generally constant diameter portion of the tubular extending from or to a radially-protruding collar, or between two radially-protruding collars). In another embodiment, the movement of the slips 12 may allow the slips 12 to drop the shaft of the tubular; however, the embodied apparatus 2 can limit upward movement of the slips 12 to a distance insufficient to permit the collar of the tubular from passing through the bore 11 of the elevator body 10. Thus, the collar of a released tubular may impact the upper surface of the slips 12, resetting the slips 12 into the elevator body 10. Accordingly, this may enable the slips 12 to again engage the tubular, thereby transferring the weight of the tubular string to the elevator 1. In still another embodiment, the slips 12 may be configured to engage a collar of the tubular during normal operation. As such, the radially-outward movement of the slips 12 allowed by the apparatus 2 may be insufficient for the slips 12 to release and fit over the collar.

Figure 5:
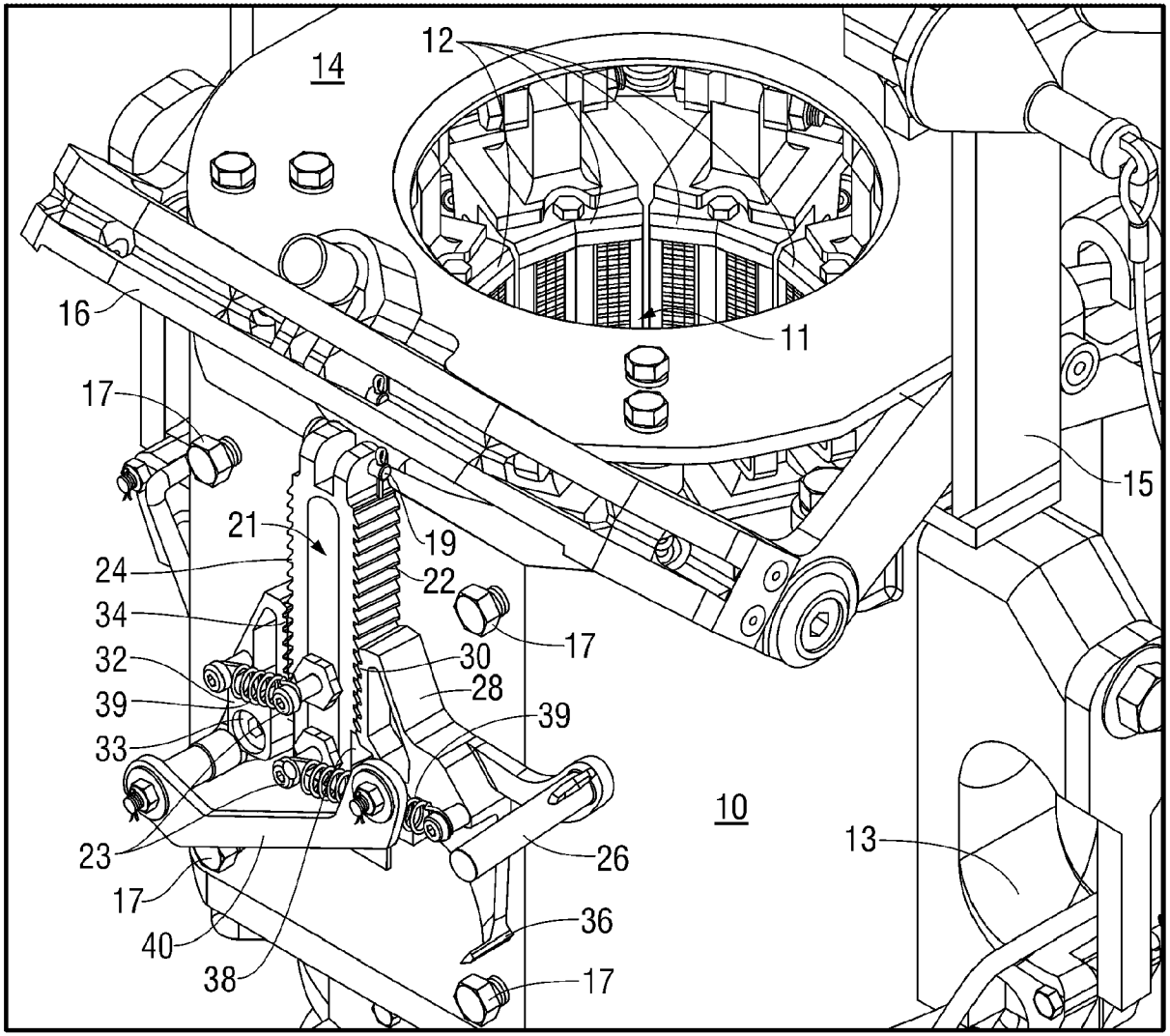
FIG. 5 illustrates a perspective view of an elevator including the apparatus of FIGS. 2-4, with the apparatus and the slips in an engaged position, according to one or more embodiments described.

FIG. 5 illustrates a perspective view of an elevator 1 with the exemplary apparatus 2 coupled to the elevator body 10, and being disposed in an engaged position. The slips 12 may also be in an engaged or lowered position to engage a tubular (not shown). The timing ring 14 may be coupled to the slips 12 to enable movement thereof. The yoke 16 may be engaged with the timing ring 14 to enable manual raising of the slips 12 and to provide a point of attachment with the locking arm 20 of the apparatus 2 via the depicted pin 19 or a similar manner of engagement.

The engagement arms 28, 32 are shown in the engaged position relative to the locking arm 20, as described above with reference to FIG. 4. In the engaged position, the complementary teeth 30 of the first engagement arm 28 contact the first set of teeth 22 of the locking arm 20, and the complementary teeth 34 of the second engagement arm 32 contact the second set of teeth 24 of the locking arm 20. When the apparatus 2 is engaged as shown, movement of the locking arm 20 in an upward direction, corresponding to movement of the slips 12 downward into the elevator body 10 for engagement with a tubular will be permitted, while movement of the locking arm 20 in a downward direction, corresponding to movement of the slips 12 upward relative to the elevator body 10, is limited through engagement between abutting sets of teeth 22, 24, 30, 34.

Figure 6:
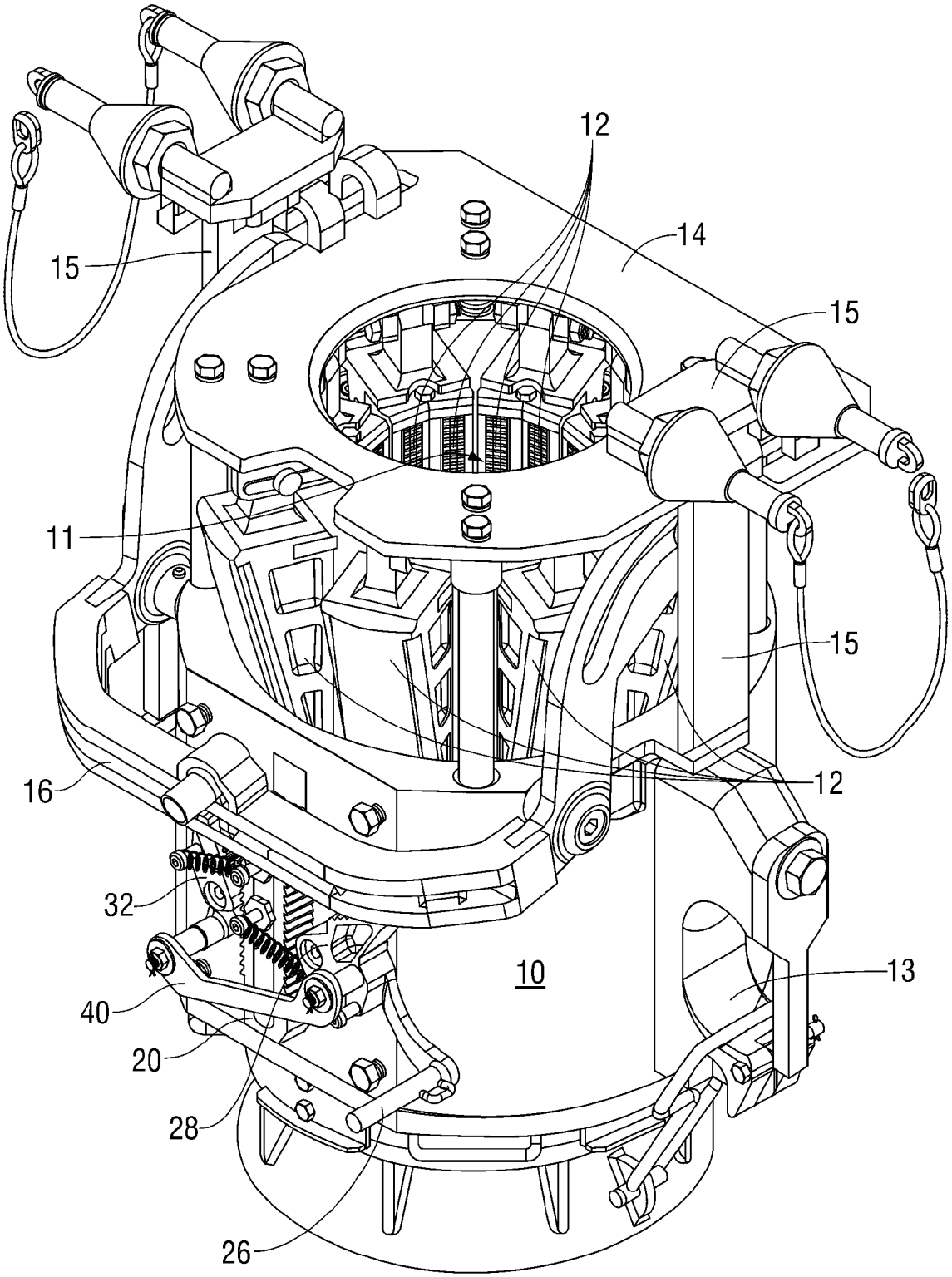
FIG. 6 illustrates a perspective view of the elevator and apparatus of FIG. 5, with the apparatus and the slips in a disengaged position, according to one or more embodiments described.

FIG. 6 illustrates a perspective view of the elevator 1 and apparatus 2, with the apparatus and the slips 12 of the elevator 1 in a disengaged position. Specifically, the timing ring 14 and slips 12 are shown in a raised position to permit passage of tubulars through the elevator body 10, while the yoke 16 and locking arm 20 are shown in a lowered position. The engagement arms 28, 32 are shown, connected by the connecting arm 40, and pivoted such that the complementary teeth 30, 34 do not contact the locking arm 20, thus permitting movement of the locking arm 20 in both upward and downward directions. The extension 36, (FIG. 5) can be engaged with the notch 38 (FIG. 5) to secure the locking arm 20 and consequently, the slips 12 in a fixed position. Actuation of the handle 26 can be used to remove the extension from the notch, thereby pivoting the engagement arms 28, 32 into contact with the locking arm 20 and permitting the locking arm 20 to move upward as the slips 12 move downward into the elevator body 10 for engagement with a tubular.

Figure 7:
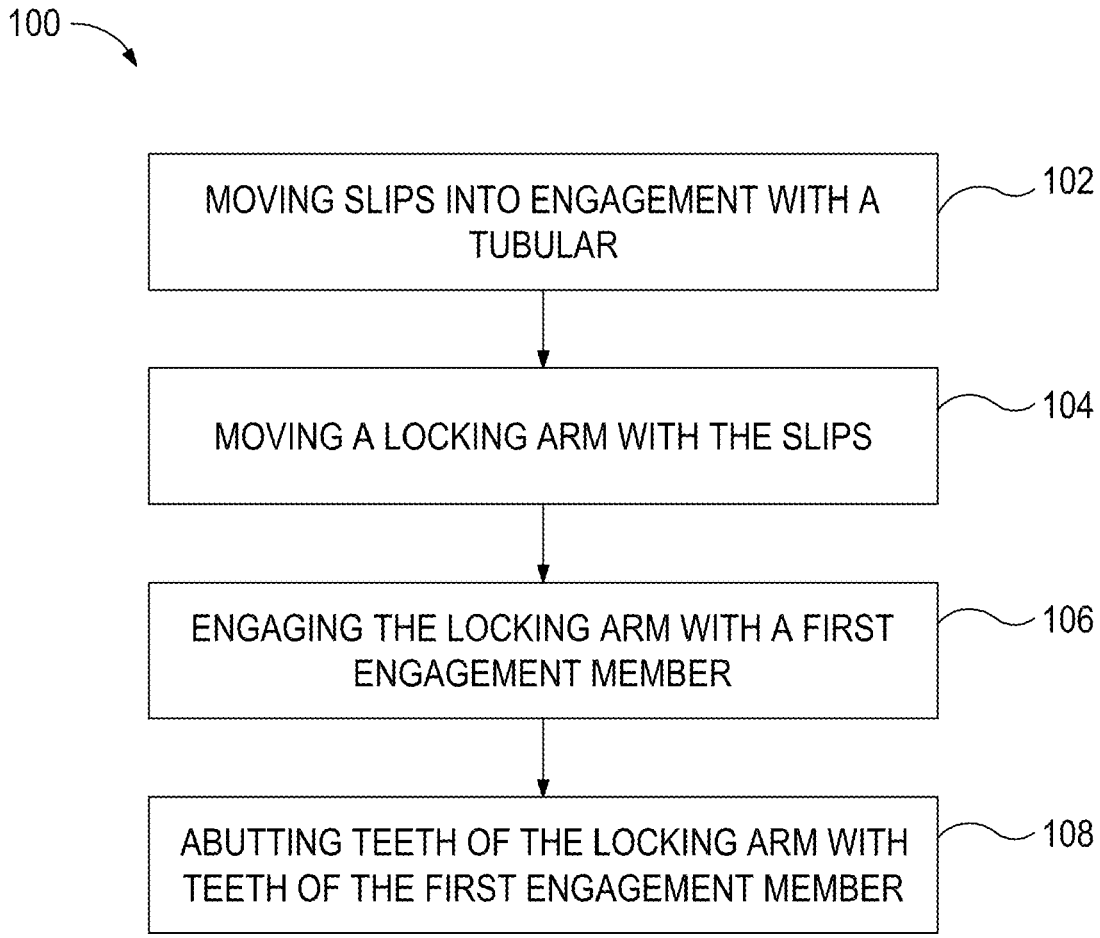
FIG. 7 illustrates a flowchart of a method for limiting slip movement in an elevator, according to one or more embodiments described.

FIG. 7 illustrates a flowchart of an exemplary method 100 for limiting movement of slips of an elevator relative to the elevator. The method 100 may proceed by operation of the elevator 1 and/or the apparatus 2 described above and may thus be best understood with reference thereto. The method 100 includes moving the slips into engagement with a tubular, as at 102. Moving the slips may require moving a locking arm therewith, as at 104. The method 100 further includes engaging the locking arm with a first engagement member, as at 106. The engagement at 106 between the locking arm and the first engagement member permits movement of the locking arm in a first direction and provides an end range for movement of the locking arm in a second direction. This limits movement of at least one of the slips relative to the elevator.

The method 100 may further include abutting the first plurality of teeth of the locking arm with the teeth of the first engagement member, as at 108. Additionally, the engaging at 106 may also include engaging teeth of the first engagement member with one or more of a first plurality of teeth of the locking arm. In an exemplary embodiment, the method 100 may also include engaging a second plurality of teeth of the locking arm with teeth of a second engagement member. As such, the abutting at 108 may proceed while the teeth of the second engagement member are at least partially disengaged from the second plurality of teeth of the locking arm, with the first and second pluralities of teeth being longitudinally offset. The method 100 may also include actuating an actuation member coupled with the first engagement member to move the engagement member from the disengaged position into the engaged position.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. An apparatus for limiting movement of gripping members relative to an elevator, comprising:

a locking arm coupled to one or more of the gripping members and configured to move in a first direction when the gripping members move toward engagement with a tubular and to move in a second direction when the gripping members move away from engagement with the tubular;

a first engagement member configured to move between a disengaged position, in which the first engagement member and the locking arm are relatively moveable, and an engaged position, in which the first engagement member allows the locking arm to move in the first direction but restrains the locking arm from moving in the second direction by more than a selected distance;

a second engagement member configured to move between a disengaged position, in which the second engagement member and the locking arm are relatively moveable, and an engaged position, in which the second engagement member allows the locking arm to move in the first direction but restrains the locking arm from moving in the second direction by more than a selected distance; and a connecting member coupled with the first engagement member and the second engagement member to transmit movement there between.

2. The apparatus of claim 1, wherein the locking arm includes a first plurality of teeth, and the first engagement member includes one or more teeth configured to engage one or more of the first plurality of teeth when the first engagement member is in the engaged position.

3. The apparatus of claim 2, wherein the second engagement member includes one or more teeth, wherein the locking arm includes a second plurality of teeth, and wherein the one or more teeth of the second engagement member are configured to engage one or more of the second plurality of teeth of the locking arm when the second engagement member is in the engaged position.

4. The apparatus of claim 3, wherein the first plurality of teeth and the second plurality of teeth are disposed on opposite longitudinal sides of the locking arm from one another and are longitudinally offset from one another.

5. The apparatus of claim 4, wherein a pitch of the first plurality of teeth and a pitch of the second plurality of teeth are equal.

6. The apparatus of claim 1, wherein the connecting member defines a groove through which the first engagement member is coupled to the elevator, the groove being configured to accommodate a movement of the first engagement member relative the locking arm without transmitting such movement to the second engagement member.

7. The apparatus of claim 1, further comprising an actuation member coupled to the first engagement member, wherein actuation of the actuation member moves the first engagement member between the engaged and disengaged positions.

8. The apparatus of claim 1, wherein the first engagement member further comprises an extension, the extension being configured to be received in a notch defined in the locking arm when the first engagement member is in the disengaged position, to retain at least one of the gripping members in a disengaged position until the actuation member is actuated.

9. An apparatus for gripping a tubular, comprising:

an annular body defining a longitudinal bore configured to receive the tubular therethrough;

slips disposed at least partially in the longitudinal bore, the slips being moveable radially and longitudinally into and out of engagement with the tubular;

a locking arm including a first plurality of teeth and a second plurality of teeth, the locking arm coupled to one or more of the slips and configured to move in a first direction when the slips move toward engagement with the tubular and to move in a second direction when the slips move away from engagement with the tubular;

a first engagement member including one or more teeth, the first engagement member configured to move between a disengaged position, in which the first engagement member and the locking arm are relatively moveable, and an engaged position, in which the first engagement member allows the locking arm to move in the first direction but restrains the locking arm from moving in the second direction by more than a selected distance; and a second engagement member including one or more teeth, the second engagement member configured to move between an engaged position and a disengaged position, wherein the one or more teeth of the first engagement member are configured to engage one or more of the first plurality of teeth of the locking arm when the first engagement member is in the engaged position, wherein the one or more teeth of the second engagement member are configured to engage one or more of the second plurality of teeth of the locking arm when the second engagement member is in the engaged position, and wherein the first plurality of teeth and the second plurality of teeth are longitudinally offset from each other.

10. The apparatus of claim 9, wherein the first engagement member and the second engagement member are pivotal between the engaged and disengaged position, and wherein the locking arm is longitudinally moveable in the first and second directions.

11. The apparatus of claim 9, wherein the first plurality of teeth and the second plurality of teeth are longitudinally offset from one another.

12. The apparatus of claim 11, wherein a pitch of the first plurality of teeth and a pitch of the second plurality of teeth are equal.

13. The apparatus of claim 9, further comprising a connecting member coupled with the first engagement member and the second engagement member such that movement of the first engagement member between the engaged and disengaged positions causes movement of the second engagement member between the engaged and disengaged positions.

14. The apparatus of claim 13, wherein the connecting member defines an elongate orifice therein through which the connecting member and the first engagement member are coupled to the body, and wherein the elongate orifice accommodates movement of the first engagement member such that movement of the locking arm relative the first engagement member does not cause movement of the second engagement member.

15. The apparatus of claim 9, further comprising an actuation member coupled to the first engagement member, wherein actuation of the actuation member moves the first engagement member from the disengaged position to the engaged position.

16. The apparatus of claim 15, wherein the first engagement member further comprises an extension, wherein the extension is configured to be received at least partially in a notch of the locking arm to prevent the locking arm from movement in the first direction.

17. A method for limiting movement of slips of an elevator relative to the elevator, comprising:

moving the slips into engagement with a tubular, wherein moving the slips requires a locking arm to move;

engaging the locking arm with a first engagement member, wherein engaging the locking arm with the first engagement member comprises:

engaging teeth of the first engagement member with one or more of a first plurality of teeth of the locking arm;

engaging a second plurality of teeth of the locking arm with teeth of a second engagement member; and abutting the first plurality of teeth of the locking arm with the teeth of the first engagement member, while the teeth of the second engagement member are at least partially disengaged from the second plurality of teeth of the locking arm, the first and second pluralities of teeth being longitudinally offset, wherein engagement between the locking arm and the first engagement member permits movement of the locking arm in a first direction and provides an end range for movement of the locking arm in a second direction, to limit movement of at least one of the slips relative to the elevator.

18. The method of claim 17, wherein further comprising actuating an actuation member coupled with the first engagement member to move the first engagement member from the disengaged position into the engaged position.

* * * * *